US005512907A

United States Patent [19]

Riza

[11] Patent Number: 5,512,907

[45] Date of Patent: Apr. 30, 1996

[54] OPTICAL BEAMSTEERING SYSTEM

[75] Inventor: Nabeel A. Riza, Clifton Park, N.Y.

[73] Assignee: General Electric Company, Schenectady, N.Y.

[21] Appl. No.: 317,055

[22] Filed: Oct. 3, 1994

[51] Int. Cl.[6] ..... H01Q 3/22

[52] U.S. Cl. ..... 342/375; 342/368

[58] Field of Search ..... 342/368, 375

[56] References Cited

U.S. PATENT DOCUMENTS

| | | | |
|---|---|---|---|
| 5,117,239 | 5/1992 | Riza | 342/375 |
| 5,187,487 | 2/1993 | Riza | 342/372 |
| 5,191,339 | 3/1993 | Riza | 342/372 |
| 5,208,880 | 5/1993 | Riza et al. | 385/18 |
| 5,231,405 | 7/1993 | Riza | 342/375 |

OTHER PUBLICATIONS

D. Dolfi et al., "Two–Dimensional Optical Architecture for Time–Delay Beam Forming in a Phased–Array Antenna," Optics Letters, vol. 16, No. 4, Feb. 15, 1991, pp. 255–257.

D. Dolfi et al., "Optically Controlled True Time Delays for Phased Array Antenna," Optical Technology for Microwave Applications IV, SPIE vol. 1102, 1989, pp. 152–161.

Dolfi et al. "Optically Controlled Time Delays for Phased Array Antenna", Optical Technology for Microwave Appl. IV, SPIE vol. 1102, 1989.

*Primary Examiner*—Gregory C. Issing

*Attorney, Agent, or Firm*—Donald S. Ingraham; Marvin Snyder

[57] ABSTRACT

An optical beamsteering system for providing a plurality of respectively time-delayed optical signals to control a phased array of transducer elements or the like includes an optical signal processing system having a plurality of optical time delay units optically coupled together in a cascade. In each optical time delay unit includes a respective multiple-pass optical delay path apparatus in which respective optical signals passing through the delay path apparatus pass along either a direct path or a delay path dependent upon the polarization orientation of the light. The delay path apparatus includes optical components disposed such that optical signals passing along the delay path pass through a given fiber delay line twice before passing from the multiple-pass optical time delay unit so as to cancel out any uncommanded polarization shifts resulting from passage of the optical signal through the fiber.

17 Claims, 2 Drawing Sheets

OPTICAL BEAMSTEERING SYSTEM

BACKGROUND OF THE INVENTION

This invention relates generally to optical signal processing systems and more particularly to beamsteering systems for phased array systems such as ultrasound devices and radar systems.

Phased array devices are used in a wide variety of systems in which it is desired to form or steer a beam of vibratory energy (as used herein, "vibratory energy refers to different modalities of radiating energy through a medium, including, but not limited to, electromagnetic energy (as in radar), sonic energy (as in sonar), and ultrasonic energy (as in ultrasound devices)). In a radar system, for example, the sequential activation of antenna elements is used to direct the beam of electromagnetic energy in a desired direction, that is, along a selected axis with respect to the array of antenna elements. Similar beamsteering can be used in ultrasound devices for medical or industrial purposes and sonar systems.

Conventional phased array beamsteering systems typically have electronic components to generate the sequential time delays to generate the radiated signal and to process the return signal. One disadvantage of such electronic systems is the large number of electrical delay elements and amplifiers that are required. Such electronic beamsteering systems are complex to assemble and maintain, and the number and nature of components present numerous potential failure modes. Further, signal losses in the delay components coupled in sequential stages may reduce the system's operational sensitivity.

For many applications, such as ultrasound devices, it is desirable to have a large number of transducer elements in an array to provide a higher resolution focused beam for tissue diagnostics, as well has high transmit power. Electronic-only beamsteering systems for large arrays (e.g., 512 to 1024 transducer element arrays compared to conventional arrays of 128 to 256 transducer elements) is large and bulky and requires a complex network of EMI sensitive RF networks. Further, long time delays necessary for such a large ultrasound array result in high RF losses and increased timing control sensitivity.

Opto-electronic signal processing has been applied in a variety of communications and radar systems. For example, for phased array radar systems, opto-electronic processing can be used to generate either time delayed or phase shifted optical signals. See, e.g., U.S. Pat. Nos. 5,117,239 and 5,191,339, which are assigned to the assignee herein and are incorporated by reference. For long time delays (e.g. about 4 ns. or more) fiber delay units are used. Such processing systems depend upon use of linearly polarized light, which generally necessitates that system components be selected that minimize the undesired shifting of polarization of the light signals. Most polarization maintaining (PM) fibers, however, not only have a higher cost but also have a high induced optical birefringence that can cause shifts in polarization orientation of the light passing through the fiber from thermal effects or mechanical perturbations.

A phased array beamsteering system is desirably compact, relatively immune to undesirable electromagnetic radiation, and straightforward to fabricate, operate, and maintain. Such a system also preferably has inertialess, motion-free operation that is readily adapted for reliable operation in a number of environments, such as portable equipment, or in aircraft or ships.

It is accordingly an object of this invention to provide a rugged high performance optical beamsteering system in which uncommanded shifts in the polarization orientation of light passing therethrough is minimized.

It is a further object of this invention to provide a high performance optical beamsteering system adapted for use in ultrasound equipment that is relatively compact, lightweight, and inertialess.

SUMMARY OF THE INVENTION

In accordance with the present invention an optical beamsteering system for providing a plurality of respectively time-delayed optical signals includes an optical signal processing system having a plurality of optical time delay units optically coupled together in a cascade. Each optical time delay unit includes a respective spatial light modulator (SLM) optically coupled to a respective multiple-pass optical delay path apparatus such that respective optical signals passing through the delay path apparatus pass along either a direct path or a delay path dependent upon the polarization orientation of the light, and such that optical signals passing along a the delay path pass through an optical fiber delay line twice before passing from the multiple-pass optical time delay unit.

Each SLM has an array of liquid crystal pixels disposed so that respective ones of said optical signals pass through a respective one of the pixels such that each optical signal emerges from the SLM having a selected linear polarization orientation. The multiple-pass optical delay path apparatus includes a polarizing beam splitter (PBS), a plurality of optical delay fibers (one for each of the plurality of optical signals that are processed concurrently by the system), and a first and a second quarter wave plate.

Each of the optical delay lines (or fibers) is optically coupled at a respective first terminus of the fiber to the first quarter wave plate and is optically coupled at a respective second terminus of the fiber to the PBS. The second quarter wave plate is optically coupled to the PBS so as to receive optical signals passing through the PBS from the optical delay lines. A first reflector is optically coupled to the first quarter wave plate such that an optical signal emerging from the delay line and passing through the quarter wave plate is reflected back through the quarter wave plate and into the same optical delay fiber from which it had emerged. Thus, when the optical signal reenters the optical delay fiber it has a linear polarization opposite of what it had originally (as a result of two passes through the quarter wave plate). An optical signal emerging from the second pass through the optical delay fiber passes directly through the PBS, through the second quarter wave plate, is reflected by a second reflector back through the quarter wave plate and back into the PBS, now again having the same polarization as when it entered the delay path apparatus from the SLM, and is now passed out of the PBS to the next optical time delay unit in the cascade. Further, as a consequence of traversing the same fiber twice, but with different polarization orientations, any uncommanded polarization shifts resulting from passage through the fiber are offset, thus maintaining a high quality signal in each optical time delay unit.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
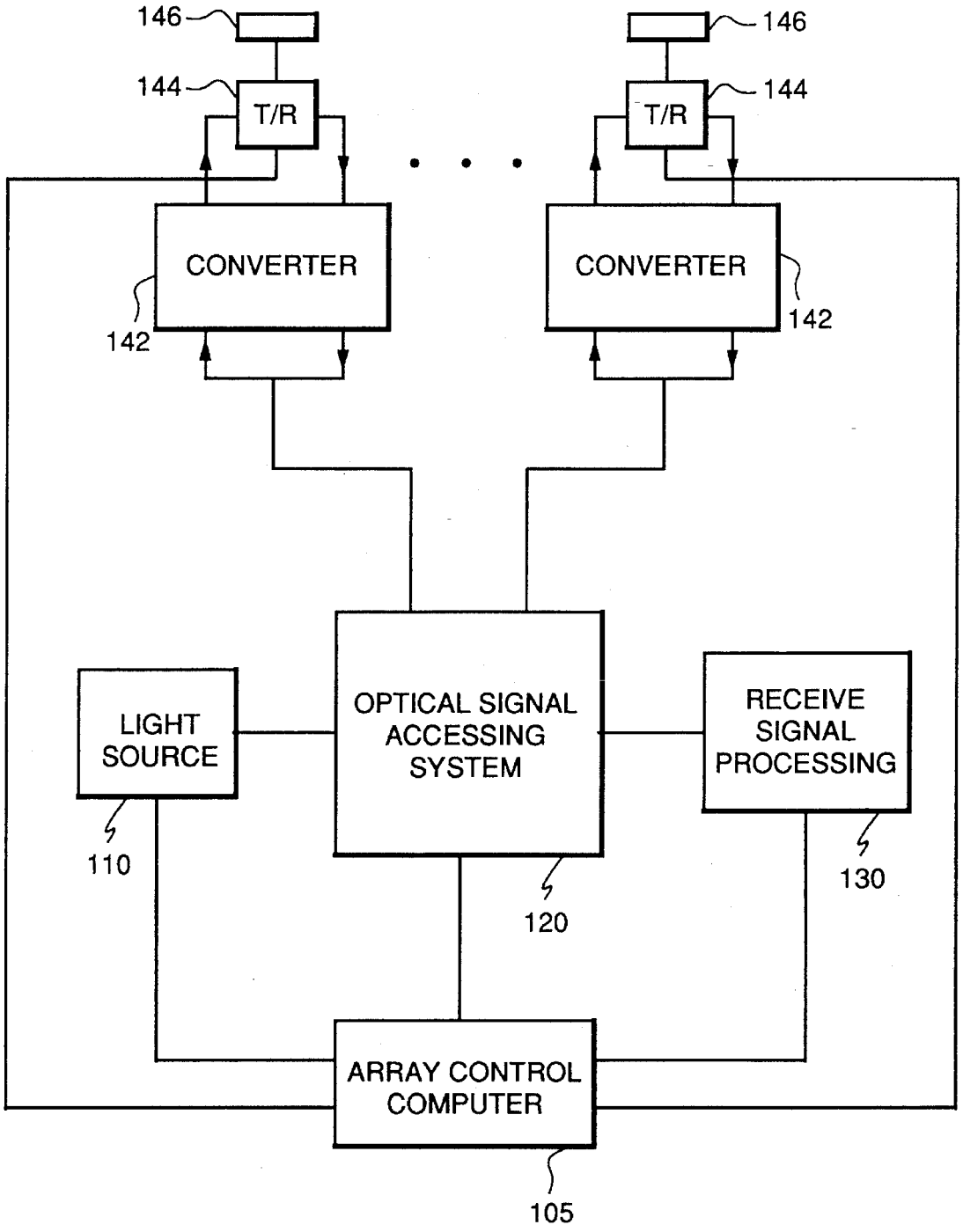
FIG. 1 is a block diagram of a optical beamsteering system in accordance with the present invention.

In FIG. 1, an optical beamsteering system 100 is shown comprising an array control computer 105 coupled to a light source 110, an optical signal processing system 120, a receive signal processing module 130, and a transducer array 140. Optical signal processing system is coupled to an array 140, which comprises a plurality of vibratory energy elements 146 (by way of example and not limitation, two representative elements are illustrated in FIG. 1 ), such as transducers or antenna elements, which radiate energy from the array and receive energy reflected to the array. Array control computer 105 is coupled to and generates signals to control and synchronize the operation, described below, of the components listed above so that optical beamsteering system 100 generates and detects radiation emanating along a desired axis from array 140.

Optical signal processing system 120 comprises the optical architecture to generate optical signals corresponding to a modulated input optical signals, manipulate those signals to differentially time delay respective ones of the optical signals, and, in a transmit mode, to drive array 140 such that respective array elements 146 are differentially actuated so that the beam generated by array 140 propagates along a selected axis with respect to array elements 146 (that is, the beam is "steered" in a selected direction). In the receive mode, signals received by respective array elements 146 are processed and the sum of the processed optical signals are converted to a corresponding electrical signal to provide an indication of the electromagnetic energy received by the array from along the selected axis. As used herein, "optical architecture" refers to the combination of devices for manipulating the direction, diffraction, polarization, or the phase or amplitude of the light beams.

Optical signal processing system 120 (FIG. 2) comprises a plurality of optical time delay units (OTDU) $\mathbf{150_1}$–$\mathbf{150_n}$ optically coupled in a cascade 125 for acting upon the light beams produced by light source 110, a cascade input module 160, and a cascade output assembly 170 optically coupled to OTDU $\mathbf{150_n}$, the last optical time delay unit in cascade 125, and to array 140. Output assembly is disposed to receive the optical signals passing from cascade 125 and, selectively for received signals, to convert the optical signals to a corresponding electrical signal via optical, or alternatively, electrical, summation; output assembly 170 is also electrically coupled to receive signal processing module 130.

Light source 110 typically comprises a laser 112 such as a semiconductor laser or the like that can provide beam intensities, electrical modulation bandwidths, linearity, polarities, and spectral purity sufficient for operation of the optical signal processing system as described in this application. Laser 112 is optically coupled to a collimating lens 114 such that collimated linearly polarized coherent light beams pass from light source 110 into cascade input module 160. As used herein, "optically coupled" refers to an arrangement in which one or more light beams are directed from one optical component to another in a manner to maintain the integrity of the signal communicated by the light beam. Laser 112 typically generates linearly polarized light appropriate for use in optical signal processing system 120; alternatively, if a non-polarized light source is used, a polarizer (not shown) is disposed to uniformly linearly polarize the light beams prior to entering cascade input module 160. For purposes of explanation and not limitation, it will be assumed that the optical signals emanating from light source 110 are polarized in the vertical plane (s-polarized), although horizontal (p-polarized) light can alternatively be used with appropriate adjustments in the optical architecture. Laser 110 is typically modulated by array control computer 105 so as to generate optical signals having a desired frequency (such as 10 MHz for medical ultrasound system, and up to 12 GHz for phased array radar systems).

Input module 160 typically comprises a polarizing beam splitter (PBS) that is disposed to direct light passing from light source 110 into cascade 120. In the example shown in FIG. 2, input module PBS 160 is disposed such that the light beams from light source 110 are deflected by 90° so that they pass into cascade 125.

Cascade 125 comprises a plurality of OTDUs $\mathbf{150_1}$–$\mathbf{150_n}$ that are sequentially optically coupled (that is, the respective OTDUs are coupled together in series such that an optical signal passes through each OTDU in the cascade). Each OTDU 150 (all OTDUs in the cascade having similar components and operate in the same way) comprises a spatial light modulator (SLM) 180 optically coupled to a delay path apparatus 200; each delay path apparatus 200 further comprises a polarizing beam splitter (PBS) 210, a plurality of optical delay fibers 220, a first quarter wave plate 230, a first reflector 240, a second quarter wave plate 250, and a second reflector 260.

The collimated light beams passing from input module 160 flood the face of SLM 180, and, as the light beams pass through pixels of SLM, form respective optical signals The individual optical signals into which the output of laser 112 is divided in OTDU $\mathbf{150_1}$ corresponds to the number of separate time delayed signals to be used in the beamsteering system (typically corresponding to the number of transducer elements in array 140 that are to be differentially actuated to steer the radiated beam). Each SLM 180 comprises a two-dimensional (2-D) pixel array arranged such that each optical signal passes from a respective one of the pixels. Each pixel advantageously comprises a liquid crystal cell that is individually controllable, that is, control voltages unique to that cell can be applied such that the rotation of the liquid crystals in any given pixel can be selected independent of control voltages applied to other pixels in the array. Such independently controllable pixel arrays typically comprise separate means of addressing each cell, such as dedicated voltage application address connections. Nematic liquid crystals or, alternatively, ferroelectric liquid crystal cells, can be used in the array. Each pixel in SLM 180 acts as a polarization rotator, rotating the polarization of the incident optical signal by 0° or 90° dependent on the control voltages applied to the liquid crystals in the cell. Application of a control voltage to select a particular polarization for an optical signal is controlled by array control computer 105 (FIG. 1).

Figure 2:
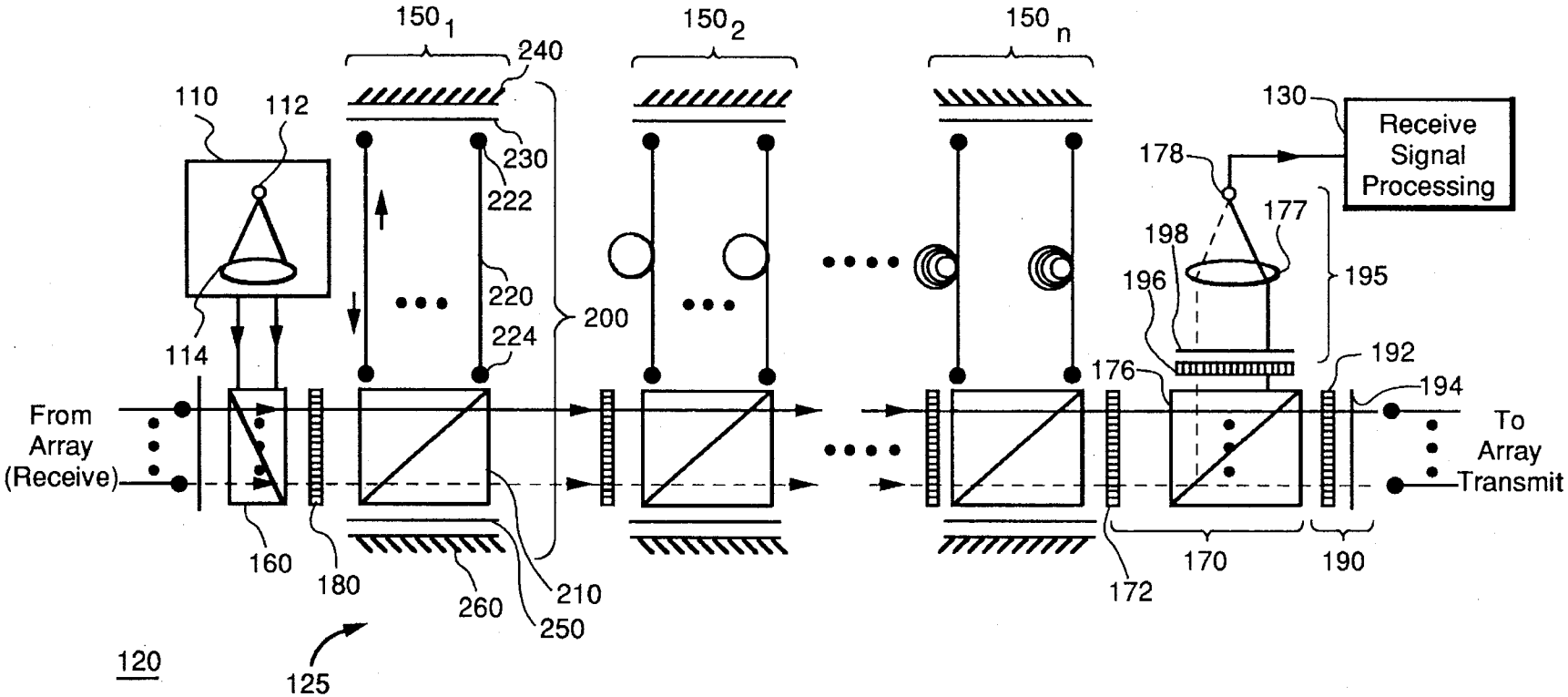
FIG. 2 is a schematic diagram of the optical architecture of an optical beamsteering system in accordance with the present invention.

In each OTDU, the respective SLM is optically coupled to the respective optical delay path apparatus 200 via PBS 210. The PBSs illustrated in FIG. 2 are cube PBSs in which light of a predetermined polarization is deflected by 90° and light of the opposite linear polarization passes through the PBS undeflected. Alternatively, other types of PBSs, such as a Thompson PBS, in which light is deflected at an angle other than 90°, can be used, with appropriate adjustments in the optical architecture. Dependent on the linear polarization of the incident optical signal, the light either passes along a direct path through the PBS or along a delay path. Light of a predetermined polarization, for example p-polarized light (horizontally polarized), passes undeflected through PBS 210 and to the next OTDU in cascade 125. An optical signal comprising light of the opposite polarization (e.g., s-polarized light (vertically polarized) for the purposes of the example description)is deflected in PBS 210 such that it passes along a delay path into a respective optical delay fiber 220.

In accordance with this invention, each OTDU 150 comprises a double pass delay path, that is, an optical signal that is deflected along the delay path passes at least twice through a respective optical delay fiber 220 in one OTDU. Each optical delay fiber 220 in a given OTDU is optically coupled at a first terminus 222 of the fiber to quarter wave plate 230, and thence to first reflector 240. Quarter wave plate 230 comprises a polarization shifting device that shifts the linear polarization of the optical signal passing therethrough by 45°; reflector 240 comprises a mirror or the like disposed so that the incident optical signal is reflected back along the same path on which it arrived at reflector 240. Thus, an optical signal having a linear polarization orientation such that it is deflected into the delay path (s-polarization for purposes of the example) passes through a respective optical delay fiber 220, through quarter wave plate 230 (causing a first 45° polarization orientation shift), thence to reflector 240 at which it is reflected back through first quarter wave plate 230, causing a second 45° polarization shift such that the optical signal now has the opposite polarization orientation that it had when it passed from fiber delay line first terminus 222 (the optical signal would now be p-polarized, for the purposes of the example discussion).

The optical signal then passes back into the same optical delay fiber 222; upon emerging from second terminus 224 of the delay fiber 220, the (now p-polarized (horizontally polarized)) optical signal passes directly through PBS 210. PBS 210 is optically coupled to second quarter wave plate 250 and second reflector 260 such that the optical signal from the delay fiber passes through PBS 210, through second quarter wave plate 250 (causing a third 45° polarization shift), is reflected by reflector 260 back through quarter wave plate 250 (causing a fourth 45° polarization shift) so that the optical signal now again has the same polarization that it had when it entered the delay path apparatus (s-polarized (vertically polarized), for the purposes of the example). This s-polarized optical signal passes back into PBS 210, in which the optical signal is deflected (by 90° as illustrated in FIG. 1) so that it passes from OTDU $\mathbf{150}_1$ and into OTDU $\mathbf{150}_2$. The operation of each OTDU in cascade 125 is similar.

The length of the optical delay fiber 220 determines the time delay imparted to the optical signal in a respective OTDU; each respective delay fiber in a given OTDU has the same length so that a given time delay can be selectively imparted each optical signal in correspondence with the polarization orientation imparted by a respective pixel in SLM 180. Typically each respective OTDU (e.g., OTDU $\mathbf{150}_1$, $\mathbf{150}_2$, $\mathbf{150}_n$, etc.) has a different length delay path than the other OTDUs in the cascade; these different length delay paths in respective OTDUs typically correspond to the desired incremental time delay $\tau$ desired to be imparted to the signal to be processed. Thus, for example, the cascade of OTDUs is advantageously arranged such that sequentially coupled OTDUs comprise respective delay paths of sufficient length to respectively introduce delays of $\tau$, $2\tau$, $3\tau$, etc. As one optical signal can be directed through multiple delay paths as it passes through the cascade, a large number of possible time delays are obtainable with relatively few OTDUs coupled in the cascade. Typical delay times for use with ultrasound type of devices range to about 5 μsec; delay times for radar type applications range to about 10 nsec.

The structure of the present invention thus results in an optical signal that is deflected onto the delay path in any one of the OTDUs to have two passes through the same optical delay fiber. Further, the polarization orientation of the optical signal is shifted by 90° before its second pass through the same optical delay fiber, thereby resulting in any uncommanded polarization shifts resulting from the transit through the delay fiber (due to thermal or mechanical perturbations of the fiber) are cancelled out. As a consequence, optical delay fibers need not be polarization-maintaining (PM) fibers, but rather may comprise standard, non-PM fibers, such as single mode telecom fibers.

Each OTDU may additionally comprise additional optical components (not shown) to provide desired optical performance. For example, each optical delay fiber is typically coupled to its respective PBS by a lens, such as a GRIN (graded index) lens.

The last OTDU in cascade 125, OTDU $\mathbf{150}_n$, is optically coupled to output assembly 170, which comprises a transmit/receive (T/R) optical switch 172 (optically coupled to an output PBS 176. Transmit/receive switch 172 typically is an SLM comprising a two-dimensional (2-D) array of liquid crystal pixels. Transmit/receive SLM 172 typically is similar in construction to OTDU SLMs 180, comprising an array of individually controllable liquid crystal pixels arranged in the same pattern so as to receive each respective optical signal passing from the cascade into a respective pixel of SLM 172. The optical signals entering output assembly SLM 172 have known linear polarizations (that is, p or s polarized for each respective beam), and thus a desired polarization rotation can be applied in transmit/receive SLM 172 to provide a desired polarization to cause the optical signals to be deflected in output PBS 176 to either a transmit output stage 190 or alternatively a receive output stage 195 of the output assembly 170.

Transmit output stage 190 comprises a transmit amplitude weighting SLM 192 optically coupled to a polarizer 194 so as to provide respective amplitude weighting of respective differentially time delay optical signals. Such amplitude weighting is provided by first rotating the polarization orientation (the range of rotation being between 0° and 90°) of an optical signal by a selected amount (all the optical signals passing to the transmit output stage 190 from output PBS 176 having the same polarization orientation). The orientation of the transmission axis of output polarizer 194 is disposed such that, dependent on the polarization orientation of light beams emanating from output stage SLM 192, the light beams are selectively attenuated as they pass through polarizer 194. The optical signals passing from transmit output stage 190 are then coupled to array 140 as described in greater detail below.

Receive output stage 195 similarly comprises a receive output stage SLM 196 and a polarizer 198 that provides amplitude weighting of the receive path signals in the same manner as described above with respect to the transmit output stage 190. Receive output stage 195 further comprises a focusing lens 177, and a photosensor 178 which are optically coupled to receive the amplitude-weighted optical signals passing from polarizer 198 and to sum all optical signals from the cascade. For example, lens 177 focuses the plurality of optical signals on photosensor 179 to optically sum the signals.

Output assembly module 170 is optically coupled to array 140 such that respective optical signals are coupled to a respective array element 146. In the transmit mode, the optical signal passing from cascade 125 is directed to a converter 142 (such as a photosensor, or the like) in which the optical signal generates a corresponding electrical signal (that is, having a corresponding modulation frequency, amplitude, and time delay with respect to the other optical signals). Converter 142 is electrically coupled to a transmit/receive switch 144, which in turn selectively couples the converter output to transducer 146. Each transmit/receive switch 144 is typically coupled to array control computer 105, which controls the position of the switch. In the receive mode, the electrical signal generated by transducer 146 in response to received vibratory energy is coupled via switch 144 to converter 142, in which the electrical signal is converted into an optical signal and thence directed back to the input to cascade 125 via PBS 160. Converter 142 thus provides both optical to electrical conversion of optical signals passing from optical signals processing system 120 in the transmit mode and further provides electrical to optical conversion of electrical signals from array elements 146 in the receive mode.

In operation, light source 110 is modulated at frequency selected for a particular application (e.g., for ultrasound use, in the range between about 4 MHz and 15 MHz, and for radar use, in the range between about 1 GHz and 12 GHz). Light from light source 110 passes into cascade 125 of OTDUs $\mathbf{150}_1$–$\mathbf{150}_n$. In each OTDU 150, the light passes into the respective pixels of SLM 180 which correspond to the respective optical signals that will be processed. Each optical signal passing from SLM 180 has a selected linear polarization determined by whether the polarization orientation is rotated by 90° in the pixel. Dependent on the polarization orientation of the optical signal, it passes through the optical delay path apparatus on a direct path (that is, is not delayed), or on a delay path (thereby introducing a delay in the signal). In each delay path, the optical signal travels through the same optical delay fiber 222 twice (and at each passage having a different respective linear polarization due to passage through first quarter wave plate 230) such that any uncommanded polarization orientation shifts are canceled out. The plurality of differentially time delay signals emerging from the cascade are then used to drive respective array elements 146 which collectively generate a radiated beam along a selected axis from the array.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An optical beamsteering system for providing a plurality of respectively time-delayed optical signals, said optical beamsteering system comprising an optical signal processing system comprising a plurality of optical time delay units optically coupled together in a cascade, each of said optical time delay units further comprising:

a respective spatial light modulator (SLM) having an array of liquid crystal pixels disposed such that respective ones of said optical signals pass through a respective one of said pixels such that each optical signal emerges from said SLM having a selected linear polarization orientation; and a respective multiple-pass optical delay path apparatus optically coupled to said respective optical time delay unit SLM to receive said respective optical signals from said SLM, said multiple-pass optical delay path apparatus comprising a polarizing beam splitter (PBS), a plurality of optical delay fibers, and a first and a second quarter wave plate, each of said optical delay lines being optically coupled at a respective first terminus of said fiber to said first quarter wave plate and optically coupled at a respective second terminus of said fiber to said PBS, said second quarter wave plate being optically coupled to said PBS so as to receive optical signals passing through said PBS from said optical delay lines, said PBS in each respective multiple-pass optical time delay unit being disposed such that respective ones of said optical signals pass along a direct path or a delay path dependent upon the polarization orientation of said respective optical signal and such that optical signals passing along a respective delay path pass through one respective fiber delay line twice before passing from said multiple-pass optical time delay unit.

2. The beamsteering system of claim 1 wherein each optical delay fiber in a respective optical time delay unit has the same length so as to provide the same time delay for each optical signal passing along respective delay paths in said optical time delay unit.

3. The beamsteering system of claim 2 wherein the length of optical delay fibers in each respective optical time delay units is different than the length of optical delay fibers in other optical time delay units in said cascade, the time delay imparted to an optical signal passing along a delay path in a respective optical time delay unit corresponding to the length of said optical delay fiber.

4. The beamsteering system of claim 3 wherein each of said polarizing beam splitters (PBS) comprises a PBS selected from the group consisting of cube type PBSs and Thompson-prism type PBSs.

5. The beamsteering system of claim 1 wherein each of said optical time delay units further comprises a first optical reflector, said first optical reflector being optically coupled to said first quarter wave plate so as to reflect an optical signal passing from said first quarter wave plate back through said first quarter wave plate and along a path such that said optical signal enters the same optical delay fiber through which the optical signal had passed from said PBS.

6. The beamsteering system of claim 5 wherein each of said optical time delay units further comprises a second optical reflector coupled to said second quarter wave plate such that optical signals passing along said delay path from said PBS through said quarter wave plate are reflected back through said second quarter wave plate and into said PBS along substantially the same path on which said optical signal had passed from said PBS.

7. The beamsteering system of claim 1 wherein said optical delay fibers comprise non-polarization maintaining single mode fibers.

8. The beamsteering system of claim 1 wherein said optical delay fibers comprise non-polarization maintaining fibers.

9. The beamsteering system of claim 1 further comprising a modulated light source coupled to said cascade and disposed to generate a plurality of optical signals, each of said optical signals having a selected linear polarization.

10. The beamsteering system of claim 9 wherein said modulated light source comprises a laser and a collimating lens optically coupled to said laser and to said cascade of optical time delay units such that light signals passing from said laser source are collimated along paths causing them to pass through respective pixels in said optical time delay unit SLM.

11. The beamsteering system of claim 9 further comprising an output assembly coupled to said cascade of optical time delay units so as to convert the sum of the plurality of optical signals to a corresponding electrical output signal.

12. The beamsteering system of claim 11 wherein said output assembly further comprises an amplitude weighting spatial light modulator (SLM) having an array of liquid crystal pixels arranged in a pattern corresponding to the pattern of said optical time delay unit SLMs.

13. The beamsteering system of claim 1 wherein beamsteering system further comprises an array of vibratory energy elements, each of said elements being coupled to said optical signal processing system such that each vibratory energy element is coupled to a respective optical signal path in said cascade through respective optical-electrical and electrical-optical converters to be selectively activated by optical signals from said cascade so as to radiate and receive energy as a phased array.

14. The beamsteering system of claim 13 wherein each of said vibratory energy elements comprises an ultrasound transducer.

15. The beamsteering system of claim 13 wherein each of said vibratory energy elements comprises a phased array radar antenna element.

16. The beamsteering system of claim 13 wherein said optical-electrical and electrical to optical converter comprises a fiber optic transmitter and receiver.

17. The beamsteering system of claim 13 further comprising a transmit output stage amplitude weighting apparatus and a receive output stage amplitude weighting apparatus.

* * * * *